United States Patent [19]

Shen et al.

[11] Patent Number: 4,737,203

[45] Date of Patent: Apr. 12, 1988

[54] METHOD FOR REDUCING CORE LOSSES OF GRAIN-ORIENTED SILICON STEEL USING LIQUID JET SCRIBING

[75] Inventors: Tien-Hung Shen; James A. Salsgiver, both of Sarver, Pa.

[73] Assignee: Allegheny Ludlum Corporation, Pittsburgh, Pa.

[21] Appl. No.: 12,516

[22] Filed: Feb. 9, 1987

Related U.S. Application Data

[63] Continuation of Ser. No. 803,361, Dec. 2, 1985, Pat. No. 4,680,062.

[51] Int. Cl.[4] ..... H01F 1/04

[52] U.S. Cl. ..... 148/111; 148/113

[58] Field of Search ..... 148/110, 111, 112, 113; 72/54, 56

[56] References Cited

U.S. PATENT DOCUMENTS

| | | | |
|---|---|---|---|
| 3,647,575 | 3/1972 | Fiedler et al. | 148/111 |
| 3,990,923 | 11/1976 | Takashina et al. | 148/111 |
| 4,299,105 | 11/1981 | Whitworth | 72/54 |
| 4,513,597 | 4/1985 | Kimoto et al. | 72/53 |
| 4,548,656 | 10/1985 | Kimoto et al. | 148/111 |

FOREIGN PATENT DOCUMENTS

| | | | |
|---|---|---|---|
| 50-35904 | 11/1975 | Japan | 72/54 |

*Primary Examiner*—John P. Sheehan

*Attorney, Agent, or Firm*—Patrick J. Viccaro

[57] ABSTRACT

A method is provided for improving core loss of grain-oriented silicon steel by scribing the steel after cold rolling in a direction substantially transverse to the rolling direction by directing a pressurized liquid jet onto the steel surface to form selected spaced-apart scribe lines. The jet may contain solid particles which increase the scribing efficiency.

11 Claims, No Drawings

METHOD FOR REDUCING CORE LOSSES OF GRAIN-ORIENTED SILICON STEEL USING LIQUID JET SCRIBING

This is a continuation of application Ser. No. 803,361, filed Dec. 2, 1985, now U.S. Pat. No. 4,680,062.

BACKGROUND OF THE INVENTION

This invention relates to a method for working the surface of grain-oriented silicon steel to affect the domain size and reduce core losses. More particularly, this invention relates to providing localized strains on the surface of grain-oriented silicon steel by using pressurized liquid jets.

In the manufacture of grain-oriented silicon steel, it is known that secondary recrystallization texture, e.g., Goss texture (110)[001], in accordance with Miller's indices, results in improved magnetic properties, particularly permeability and core loss. The Goss texture refers to the body-centered cubes making up the grain or crystals being oriented in the cube-on-edge position. The texture or grain orientations of this type refers to the cube edges being parallel to the rolling direction and in the plane of rolling, and the cube face diagonals being perpendicular to the rolling direction and in the rolling plane. As is well known, steels having this orientation are characterized by a relatively high permeability in the rolling direction and a relatively low permeability in a direction at right angles thereto.

In the manufacture of grain-oriented silicon steel, typical steps include providing a melt on the order of 2–4.5% silicon, casting the melt, such as by a continuous casting process, hot rolling the steel, cold rolling the steel to final gauge with an intermediate annealing when two or more cold rollings are used, decarburizing the steel, applying a refractory oxide base coating, such as magnesium oxide coating, to the steel, and final texture annealing the steel at elevated temperatures in order to produce the desired secondary recrystallization and purification treatment to remove impurities, such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

Grain-oriented silicon steel is conventionally used in electrical applications, such as power transformers, distribution transformers, generators and the like. The silicon content of the steel in electrical applications permits cyclic variation of the applied magnetic field with limited energy loss, which is termed core loss. It is desirable, therefore, in steels of this type to reduce core loss.

It is known that core loss values of grain-oriented silicon steels may be reduced if the steel is subjected to any of various practices to induce localized strains in the surface of the steel. Such practices may be generally referred to as "scribing" and may be performed either prior to or after the final high temperature annealing operation. If the steel is scribed after the decarburization anneal but prior to final high temperature texture anneal, then the scribing generally controls the growth of the secondary recrystallization grains to preclude formation of large grains and so results in reduced domain sizes. U.S. Pat. No. 3,990,923, issued Nov. 9, 1976, discloses methods wherein prior to the final high temperature annealing, a part of the surface is worked, such as by mechanical plastic working, local thermal treatment, or chemical treatment.

If the steel is scribed after final texture annealing, then there is induced a superficial disturbance of the stress state of the texture annealed sheet so that the domain wall spacing is reduced. These disturbances typically are relatively narrow, straight lines, or scribes generally spaced at intervals equal to or less than the grain size of the steel. These scribe lines are typically transverse to the rolling direction and typically applied to only one side of the steel. U.S. Pat. No. 3,647,575, issued Mar. 7, 1972, discloses a method wherein watt losses are to be improved in cube-texture silicon-iron sheets after annealing and complete recrystallization. The method includes partially plasticly deforming the sheet surface by providing narrowly spaced shallow grooves, such as by a cutter or abrasive powder with pressure applied. The sheet is preferably scribed on opposite sides in different directions.

There have also been attempts to improve the magnetic properties of steel after final texture annealing by projecting particles, such as steel shots, onto substantially linear selected portions of a grain-oriented steel sheet to produce strains in the regions. U.S. Pat. No. 4,513,597, issued Apr. 30, 1985, discloses an apparatus including an endless belt loop in which slits are formed at a predetermined distance and elongated in the direction perpendicular to the path of travel and movable at the speed synchronously with the speed of the steel sheet. The apparatus includes a means for projecting particles through the slits and against the steel sheet.

In the use of such grain-oriented silicon steels during fabrication incident to the production of transformers, for example, the steel is cut and subjected to various bending and shaping operations which produce stresses in the steel. In such instances, it is necessary and conventional by manufacturers to stress relief anneal the product to relieve such stresses. During stress relief annealing, it has been found that the beneficial effect on core loss resulting from some scribing techniques, such as thermal scribing, are lost.

What is needed is a method for reducing the core loss values over that which are available to grain-oriented silicon steels which are not subjected to scribing, i.e., which are only final texture annealed. It is desirable that a method be developed for scribing such steel wherein the scribe lines required to improve the core loss values of the steel may be applied in a uniform and efficient manner to result in uniform and reproducably lower core loss values. A low cost scribing practice should be compatible with the conventional steps and equipment for producing grain-oriented silicon steels, and, furthermore, such improvements in core loss values should be able to survive stress relief annealing which are incident to the fabrication of such steels into end product.

SUMMARY OF THE INVENTION

In accordance with the present invention, a method is provided for improving core loss of grain-oriented silicon steel strip after cold rolling to final gauge by scribing the steel in a direction substantially transverse to the rolling direction by directing a pressurized liquid jet onto the steel surface to form selected spaced-apart scribe lines. The scribing may be done prior to or after final texture annealing of the cold-rolled final gauge steel. The liquid jet pressure may be in excess of 1000 psi and may further contain solid particles which when directed to the steel surface further facilitate scribing to improve core loss.

DETAILED DESCRIPTION OF THE PREFERRED EMBODIMENTS

Broadly, in accordance with the practice of the invention, the core loss of grain-oriented silicon steel which has been cold rolled to final gauge is improved by scribing the steel in a direction substantially transverse to the rolling direction, with the scribing being accomplished by directing a pressurized liquid jet onto a surface of the steel strip. The scribing of a scribe line may be effected by moving the pressurized liquid jet along a surface of the strip in a direction substantially transverse to the rolling direction. In the alternative, a scribe line could be effected by a plurality of liquid jets directed to and impacting on the steel strip to produce a scribe line. It has been found that the width and depth of the scribe line produced depends upon the pressure, size of the nozzle, standoff distance from the steel strip, and the speed of scribing in those embodiments where the jet is moved across the strip surface.

The liquid used to form the pressurized jet may be any suitable liquid. Typically, in prior art nozzles wherein pressurized liquids are used to cut metals, ceramics, and glass, water is a typical liquid used. For purposes of the present application, other liquids, such as a refractory oxide slurries and finish coating slurries which are frequently used in conventional processes for producing grain-oriented silicon steel, may prove useful. Conventional slurries may include phosphates of magnesium and aluminum. A possible limitation on the use of some liquids may be the ability to pressurize and eject the liquid from the nozzles without undue problems such as clogging. In accordance with the present invention, liquids to be used in the jet may be selected from the group consisting of water, refractory oxide slurries, and finish coating slurries.

For scribing the surface of the electrical steel, a high pressurized liquid jet is necessary. Broadly, the pressures may range from 1000 up to 60,000 psi (6.8948 up to 413.688 MPa) or more. Preferably, the pressure of the liquid jet may range from 30,000 up to 60,000 psi (206.844 up to 413.688 MPa). The actual pressure necessary will depend upon the size of the nozzle used, the standoff distance, and the speed of scribing.

Although any suitable water jet nozzle and system may be useful in the practice of the method of the present invention, one suitable water jet nozzle and and system has been found manufactured by Flow Systems, Inc., of Kent, Wash. In order to better understand the present invention, the above-referenced liquid jet system was used in the following example.

Conventional grain-oriented silicon steel was produced by casting, hot rolling, normalizing, cold rolling to intermediate gauge, annealing and cold rolling to final gauge, decarburizing, and final texture annealing to achieve the desired secondary recrystallization of cube-on-edge orientation. The steel melt initially contained the nominal composition of:

| C | N | Mn | S | Si | Cu | Fe |
|---|---|---|---|---|---|---|
| .030 | <50 ppm | .07 | .022 | 3.15 | .22 | Bal. |

After final texture annealing, the C, N, and S were reduced to trace levels of less than about 0.001%. The strip was cut into numerous pieces to produce samples for scribing. Each sample was a 20-strip Epstein pack from which the magnetic properties were obtained. A jet nozzle having an opening of 0.003 inch (0.076 mm) was used to direct a jet of water at a pressure of 55,000 psi (379.21 MPa). Each of the 20 strips in the Epstein pack were scribed with each strip positioned parallel to each adjacent strip on a magnetic fixture for scribing. The nozzle was placed about 0.25 inch (6.25 mm) away from the sample surface during scribing and was moved nominally perpendicular to the rolling direction of each sample. Scribing lines were produced with the above conditions at a spacing of about 5 mm between each scribe line with a scribe line width of between 50 to 100 μm as measured in the base metal. On the surface of the strip, the appearance of the scribe line seemed to indicate a scribe line width of about 1 mm evidenced by the change in appearance of the surface coating. It is desirable that the width of the affected area be limited to about 1.5 mm maximum. The apparent line width and the actual line width vary with scribing parameters. The results of this test, and specifically the magnetic properties as a function of variations in scribing speed, are set forth in Table I. For comparison purposes, the magnetic properties of each sample prior to scribing are also presented in the Table where no scribing speed is identified.

TABLE I

| Sample No. | Scribing Speed (in/min.) | Permeability @ 10 H | Core Loss (mWPP) @ 60 Hz 1.3 T | 1.5 T | 1.7 T |
|---|---|---|---|---|---|
| A-04 | — | 1868 | 307 | 428 | 632 |
| | 100 | 1679 | 498 | 671 | 904 |
| A-05 | — | 1871 | 307 | 428 | 632 |
| | 200 | 1857 | 314 | 441 | 649 |
| A-10 | — | 1868 | 306 | 426 | 628 |
| | 200 | 1832 | 366 | 512 | 727 |
| A-19 | — | 1869 | 307 | 428 | 623 |
| | 200 | 1837 | 364 | 506 | 720 |
| A-21 | — | 1863 | 313 | 437 | 646 |
| | 250 | 1850 | 318 | 448 | 661 |
| A-30 | — | 1874 | 310 | 432 | 636 |
| | 275 | 1867 | 306 | 428 | 630 |
| A-06 | — | 1872 | 303 | 423 | 623 |
| | 300 | 1864 | 291 | 408 | 614 |
| A-11 | — | 1868 | 306 | 427 | 628 |
| | 300 | 1860 | 294 | 412 | 620 |
| A-17 | — | 1870 | 314 | 437 | 645 |
| | 300 | 1856 | 319 | 448 | 658 |
| A-23 | — | 1867 | 306 | 428 | 634 |
| | 350 | 1860 | 301 | 421 | 630 |
| A-26 | — | 1871 | 306 | 426 | 630 |
| | 400 | 1866 | 298 | 416 | 620 |
| A-28 | — | 1867 | 307 | 426 | 631 |
| | 450 | 1862 | 302 | 420 | 626 |
| A-03 | — | 1868 | 306 | 428 | 633 |
| | 500 | 1862 | 295 | 413 | 618 |
| A-09 | — | 1871 | 304 | 423 | 627 |
| | 500 | 1867 | 289 | 403 | 603 |
| A-29 | — | 1873 | 312 | 433 | 635 |
| | 500 | 1869 | 304 | 423 | 627 |
| A-08 | — | 1870 | 309 | 430 | 630 |
| | 750 | 1868 | 299 | 416 | 617 |
| A-02 | — | 1869 | 308 | 429 | 632 |
| | 1000 | 1864 | 310 | 432 | 641 |

Under the experimental conditions described above, the water jet scribing technique starts to show core loss reductions at the scribing speed of 275 inches per minute (in./min.) and reaches a maximum of 24 mWPP in core loss reduction at 17 KG at 500 inches per minute. The effect of the liquid jet scribing appears to diminish as the speed increases up to 1000 in./min.

It is also within the scope of the invention to include solid particles in the pressurized liquid jet and directing them onto the steel surface to effect scribing. Any suitable solid particles may be used, and such particles may be made of abrasive materials. Such particles may be selected from the group consisting of garnet, silicates, metal fines, and other hard materials. Furthermore, the solid particles may be present in an amount of 0.1 up to 10% by volume in the pressurized liquid jet. Further, the liquid containing the solid particles may be in the form of a slurry containing the particulate for ejection from the nozzle or the liquid and particles may be mixed in the nozzle and ejected as a liquid jet containing the particulate. The largest particle size should be no greater than the maximum width of the line to be scribed. As a practical matter, the largest particle should be about 60 mils so as to produce a maximum scribe line width of about 1.5 mm. Such sizes correspond to about 10 mesh Tyler equivalent to U.S. standard sieve sizes. When slurries, such as refractory oxide slurries are used, the particle sizes are much smaller. Such particles may be on the order of 325 Tyler mesh size. Preferably, it has been found that the solid particles may range in size from 80 to 150 Tyler mesh of U.S. standard sieve sizes.

By way of further examples, additional tests were performed to demonstrate the improved scribing efficiency when solid particles were contained in the liquid jet. High permeability grain-oriented silicon steel strip was produced in a conventional manner and the steel had the following nominal melt composition:

| C | N | Mn | B | S | Si | Cu | Fe |
|---|---|---|---|---|---|---|---|
| .03 | <50 ppm | .035 | 10 ppm | .018 | 3.15 | .30 | Bal. |

The sample used in each test had a dimension of about 12 inches by 24 inches (30.5 by 61 cm). A water jet nozzle of Flow Systems, Inc. having a 10-mil nozzle (0.254 mm) opening and a 28-mil (0.71 mm) focusing carbide nozzle was placed at a distance of about 0.375 inch (0.954 cm) from the steel strip panel. Scribe lines substantially perpendicular to the rolling direction were produced with a distance between each scribe line of about 8 mm. The scribing speeds (in feet per minute - FPM) are faster than those speeds used for scribing without particles in the liquid jet. The solid particles were made of garnet and were present at about 1.2% by volume in the liquid jet. The samples were stress relief annealed at 1475° F. (800° C.) for one hour. The variables of water pressure, scribing speed and size of the solid particles, as well as the resulting magnetic properties, are set forth on Table II. The magnetic properties shown in Table II were measured by a Single Sheet Testing method without any correction.

TABLE II

| Scribing Parameters | | | | | | | | | |
|---|---|---|---|---|---|---|---|---|---|
| Pressure (psi) | Particle Size (Mesh) | Speed (FPM) | Sample No. | | | Before Scribing | After Scribing | After S.R.A.** | Net Change (%) |
| 20,000 | 80 | 960 | B-16 | Permeability | @ 10H | 1890 | 1794 | 1898 | |
| | | | | 60 Hz mWPP | @ 1.3T | 292 | 512 | 290 | −0.7 |
| | | | | | 1.5T | 402 | 694 | 392 | −2.5 |
| | | | | | 1.7T | 577 | 926 | 550 | −4.7 |
| 20,000 | 80 | 1170 | B-15* | Permeability | @ 10H | 1888 | — | 1903 | |
| | | | | 60 Hz mWPP | @ 1.3T | 294 | — | 285 | −3.1 |
| | | | | | 1.5T | 417 | — | 391 | −6.2 |
| | | | | | 1.7T | 583 | — | 558 | −4.5 |
| 20,000 | 100 | 926 | A-16* | Permeability | @ 10H | 1895 | — | 1898 | |
| | | | | 60 Hz mWPP | @ 1.3T | 300 | — | 298 | −0.7 |
| | | | | | 1.5T | 411 | — | 409 | −0.5 |
| | | | | | 1.7T | 596 | — | 582 | −2.3 |
| 7,500 | 80 | 1465 | A-14 | Permeability | @ 10H | 1891 | 1853 | 1888 | |
| | | | | 60 Hz mWPP | @ 1.3T | 316 | 322 | 301 | −4.7 |
| | | | | | 1.5T | 426 | 451 | 411 | −3.5 |
| | | | | | 1.7T | 618 | 658 | 592 | −4.2 |
| 7,500 | 150 | 1570 | A-5 | Permeability | @ 10H | 1873 | 1850 | 1888 | |
| | | | | 60 Hz mWPP | @ 1.3T | 303 | 308 | 301 | −0.7 |
| | | | | | 1.5T | 420 | 437 | 413 | −1.7 |
| | | | | | 1.7T | 609 | 642 | 591 | −2.9 |
| 5,000 | 100 | 1450 | A-13 | Permeability | @ 10H | 1904 | 1858 | 1909 | |
| | | | | 60 Hz mWPP | @ 1.3T | 298 | 321 | 308 | +3.4 |
| | | | | | 1.5T | 404 | 447 | 412 | +2.0 |
| | | | | | 1.7T | 578 | 651 | 582 | +0.7 |
| 5,000 | 100 | 1450 | B-11 | Permeability | @ 10H | 1882 | 1861 | 1898 | |
| | | | | 60 Hz mWPP | @ 1.3T | 318 | 309 | 305 | −4.1 |
| | | | | | 1.5T | 424 | 432 | 418 | −1.4 |
| | | | | | 1.7T | 618 | 633 | 599 | −3.1 |
| 5,000 | 150 | 1570 | A-8 | Permeability | @ 10H | 1900 | 1891 | — | |
| | | | | 60 Hz mWPP | @ 1.3T | 312 | 298 | — | −4.5 |
| | | | | | 1.5T | 423 | 411 | — | −2.8 |
| | | | | | 1.7T | 618 | 591 | — | −4.4 |
| 5,000 | 150 | 1570 | B-5 | Permeability | @ 10H | 1878 | 1880 | 1898 | |
| | | | | 60 Hz mWPP | @ 1.3T | 305 | 293 | 305 | 0 |
| | | | | | 1.5T | 419 | 407 | 418 | 0 |
| | | | | | 1.7T | 599 | 591 | 592 | −1.2 |

*Sample is only partially scribed
**S.R.A. means Stress Relief Annealing

As may be seen from Sample B-16, core loss with this sample is improved after stress relief annealing as compared to the core loss value before scribing. For this sample, the use of hard particulate in the liquid jet, high water pressures, and slow scribing speeds, made deep marks on the surface of the sample. Sample Nos. A-8 and B-5 had lighter and narrower markings on the coating; however, they showed a decrease in core loss values after scribing by the use of a water jet pressure of about 5000 psi. Preferably, the jet pressure may range from 1000 to 20,000 psi (6.8948 up to 137.89 MPa). Clearly, the presence of solid particles has been shown to increase the scribing efficiency when compared with water pressure of 55,000 psi used in the experiments with the liquid jet not containing solid particles.

It should be noted that higher scribing speeds are achievable with the use of hard particles in the liquid jet. Such higher speeds are desirable for traversing and scribing steel strip at commercial production speeds. Preferably, the scribing speeds may range up to 3000 feet per minute.

The scribing width and scribing depth depends on the pressure, size of the nozzle used, the standoff distance, the speed of scribing, and whether the jet contains liquid only or liquid and solid particles. The scribing depth appears to result from deformation and/or removal of metal. An effective scribing depth can be the entire thickness of the strip because in some cases the back surface had visible markings under the scribe lines which can be considered the deformation zone. The actual scribing depth may be up to 10 microns and typically on the order of 3 to 6 microns.

Grain-oriented silicon steel may typically range from 5 to 15 mils-thick. The data of Table I was based on 7-mil thick conventional grain-oriented steel and for Table II the steel was 9 mils-thick high permeability grain-oriented silicon steel.

Using a Scanning Electron Microscope (SEM), the scribed steel strip was examined. It was found that the coating on the final texture annealed sheet may not be continuously removed and in some cases appears lightly removed and in others heavily removed. To the unaided eye, these areas may appear dull and shiny, respectively. It has also been found that, depending on the scribing parameters, the solid particles may remain in tact and embedded in the strip surface. In all cases there appears to be a light and heavy pattern of coating removal and/or base metal removal or deformation. Such variations in the affect on the steel surface may be due to numerous factors, such as a pulsating liquid pressure, variations in coating thickness, minor changes in the standoff distance due to variations in strip thickness, various sizes of solid particles and the like.

The present invention does not appear to be limited to a particular type of grain-oriented silicon steel, although the invention will achieve the most benefits on high permeability steels having a permeability at 10 Oersteds of more than 1840 and grain size larger than about 3.0 mm, as well as on thin gauge regular oriented silicon steel of about 0.23 mm or less.

The scribing operation may be performed after final high temperature annealing, such as at the exit end of a continuous operation, such as a heat flattening and coating line. It is contemplated that the present invention is also useful for scribing cold-rolled or decarburized final gauge steel prior to final texture annealing. Furthermore, the extent or depth of scribing may be controlled as desired, depending upon whether the scribed strip will be used that way without further processing, such as in a power transformer application, or will be stress relief annealed, such as for distribution transformer applications where scribing benefits are expected to survive stress relief annealing.

Although several embodiments of the present invention have been shown and described, it will be apparent to those skilled in the art that modifications may be made therein without departing from the scope of the invention.

What is claimed is:

1. A method for improving core loss of grain-oriented silicon steel strip, said method comprising after cold rolling to final gauge, scribing the steel in a direction substantially transverse to the rolling direction by directing a pressurized liquid jet onto the steel surface and moving the jet across the strip to form selected spaced-apart scribe lines, the jet pressure being in excess of 1000 psi, the liquid jet containing solid particles in an amount of 0.1 to 10% by volume in the pressurized jet to embed some of the particles in the scribed steel strip surface.

2. The method of claim 1 wherein the scribing of the final gauge steel is conducted prior to final texture annealing.

3. The method of claim 1 wherein the scribing of the final gauge steel is conducted after final texture annealing.

4. The method of claim 1 further including moving the pressurized liquid jet across the strip substantially transverse to the rolling direction.

5. The method of claim 1 wherein the solid particles range in size from 10 to 325 Tyler mesh.

6. The method of claim 1 wherein the solid particles range in size from 80 to 150 Tyler mesh.

7. The method of claim 1 wherein said solid particles are selected from the group consisting of garnet, silicates, and metal fines.

8. The method of claim 1 wherein the liquid jet pressure ranges from 1,000 to 20,000 psi.

9. The method of claim 1 further including moving the pressurized liquid jet containing solid particles across the strip substantially transverse to the rolling direction at speeds of up to 3,000 feet per minute.

10. The method of claim 1 wherein the liquid of the jet is selected from the group consisting of water, refractory oxide slurries, and finish coating slurries.

11. A method for improving core loss of grain-oriented silicon steel strip, which has been cold rolled to final gauge, said method comprising scribing the steel after said cold rolling in a direction substantially transverse to the rolling direction by directing a pressurized liquid jet onto the steel surface to form selected spaced-apart scribe lines, the jet pressure being in excess of 1000 psi, the liquid being selected from the group consisting of water, refractory oxide slurries, and finish coating slurries containing solid particles to embed some of the particles in the scribed steel strip surface.

* * * * *